US007234973B1

(12) United States Patent
Shelly

(10) Patent No.: US 7,234,973 B1
(45) Date of Patent: Jun. 26, 2007

(54) LIGHTING SYSTEM HAVING MODIFIED LIGHT BULB BASE AND LUMINARE SOCKET FOR PREVENTING THE SELECTION OF AN OVER WATTAGE LIGHT BULB AND METHOD OF FORMING SAME

(76) Inventor: Mark E. Shelly, 590 S. Centre St., Marcellus, MI (US) 49067

( * ) Notice: Subject to any disclaimer, the term of this patent is extended or adjusted under 35 U.S.C. 154(b) by 0 days.

(21) Appl. No.: 11/387,608

(22) Filed: Mar. 23, 2006

(51) Int. Cl.
*H01R 24/00* (2006.01)

(52) U.S. Cl. ..... 439/667

(58) Field of Classification Search ..... 439/615, 439/667, 677, 678, 679, 662
See application file for complete search history.

(56) References Cited

U.S. PATENT DOCUMENTS

| | | | |
|---|---|---|---|
| 290,467 | A | 12/1883 | Perkins |
| 335,935 | A | 2/1886 | Kipper |
| 425,741 | A | 4/1890 | Bradley |
| 427,951 | A | 5/1890 | Atterbury |
| 433,371 | A | 7/1890 | Schimer |
| 438,310 | A | 10/1890 | Edison |
| 463,763 | A | 11/1891 | Voigt |
| 467,523 | A | 1/1892 | Roberts |
| 469,483 | A | 2/1892 | Manchester |
| 487,479 | A | 12/1892 | Frei |
| 509,297 | A | 11/1893 | Bryant |
| 527,989 | A | 10/1894 | Hussey |
| 595,619 | A | 12/1897 | Gates |
| 612,152 | A | 10/1898 | Bell |
| 625,903 | A | 5/1899 | Schimer |
| 656,284 | A | 8/1900 | Froschl |
| 662,110 | A | 11/1900 | Bell |
| 670,927 | A | 4/1901 | Campbell |
| 701,680 | A | 6/1902 | Chase |
| 716,595 | A | 12/1902 | Taussig |
| 730,768 | A | 6/1903 | Hoelscher |
| 730,852 | A | 6/1903 | Elliott |
| 744,957 | A | 11/1903 | Casey |
| 780,613 | A | 1/1905 | Meyers |
| 796,922 | A | 8/1905 | Morgan |
| 808,096 | A | 12/1905 | Lawrence |
| 817,484 | A | 4/1906 | Hubbell |
| 817,642 | A | 4/1906 | Hubbell |
| 819,702 | A | 5/1906 | Murphy |
| 851,495 | A | 4/1907 | Churchill |
| 888,378 | A | 5/1908 | Wood |
| 938,632 | A | 11/1909 | Benjamin |
| 955,438 | A | 4/1910 | Russell |
| 986,743 | A | 3/1911 | Murray |
| 1,048,279 | A | 12/1912 | Benjamin |
| 1,088,914 | A | 3/1914 | Marks et al. |

(Continued)

*Primary Examiner*—Khiem Nguyen
(74) *Attorney, Agent, or Firm*—Price, Heneveld, Cooper, DeWitt & Litton, LLP

(57) ABSTRACT

A lighting system that includes a light bulb having a threaded bulb base and a luminare socket. The bulb (200) includes a two conductor base (201, 205) while the luminare socket (300) utilizes a circular ring (305) with an open aperture (307) for supplying current to the bulb. The circular ring (305) and aperture (307) in the luminare socket are sized to provide contact with the center contact (205) of the light bulb when the preferred wattage is selected. This prevents over wattage light bulbs from being used avoiding excess heat, arcing and the potential for fire.

5 Claims, 3 Drawing Sheets

U.S. PATENT DOCUMENTS

| | | | |
|---|---|---|---|
| 1,120,492 | A | 12/1914 | Hino |
| 1,187,723 | A | 6/1916 | George |
| 1,201,782 | A | 10/1916 | Wilcox |
| 1,201,783 | A | 10/1916 | Wilcox |
| 1,255,943 | A | 2/1918 | Snyder |
| 1,260,085 | A | 3/1918 | Snyder |
| 1,280,926 | A | 10/1918 | Winston |
| 1,280,927 | A | 10/1918 | Winston |
| 1,322,989 | A | 11/1919 | Wolcott |
| 1,336,431 | A | 4/1920 | Halter |
| 1,336,607 | A | 4/1920 | Benjamin |
| 1,364,262 | A | 1/1921 | Faber |
| 1,389,343 | A | 8/1921 | Cuthbert et al. |
| 1,455,120 | A | 2/1923 | Wise |
| 1,481,680 | A | 2/1924 | Brindel |
| 1,504,823 | A | 8/1924 | Kline |
| 1,528,054 | A | 3/1925 | Harris et al. |
| 1,556,342 | A | 10/1925 | Peth |
| 1,585,011 | A | 5/1926 | Herskovitz |
| 1,595,522 | A | 8/1926 | Mullor |
| 1,628,183 | A | 5/1927 | Pendleton |
| 1,660,422 | A | 2/1928 | McKinley |
| 1,675,554 | A | 7/1928 | Howell |
| 1,679,338 | A | 7/1928 | Rothenberg et al. |
| 1,705,559 | A | 3/1929 | Dubilier |
| 1,721,566 | A | 7/1929 | Lofgren |
| 1,727,148 | A | 9/1929 | White |
| 1,728,485 | A | 9/1929 | Freeman |
| 1,733,504 | A | 10/1929 | MacDonald |
| 1,770,377 | A | 7/1930 | Wolfe |
| 1,795,746 | A | 3/1931 | Voorhis |
| 1,880,014 | A | 9/1932 | Bush |
| 1,906,194 | A | 4/1933 | Webster |
| 1,910,482 | A | 5/1933 | Stoddard |
| 1,911,610 | A | 5/1933 | Douglas |
| 1,914,702 | A | 6/1933 | Peth |
| 1,965,231 | A | 7/1934 | Gustin |
| 1,965,588 | A | 7/1934 | Foulke |
| 2,010,084 | A | 7/1935 | Howe |
| 2,018,134 | A | 10/1935 | Kollath |
| 2,034,561 | A | 3/1936 | Davis |
| 2,064,364 | A | 12/1936 | Thomas |
| 2,064,585 | A | 12/1936 | Atienza |
| 2,088,559 | A | 7/1937 | Kollsman |
| 2,104,945 | A | 1/1938 | Guinn |
| 2,106,394 | A | 1/1938 | Mitchell |
| 2,131,253 | A | 9/1938 | Langille |
| 2,138,780 | A | 11/1938 | Birdseye |
| 2,157,051 | A | 5/1939 | Birdseye |
| 2,160,431 | A | 5/1939 | Buser |
| 2,172,347 | A | 9/1939 | Clemence |
| 2,221,345 | A | 11/1940 | Davis |
| 2,229,403 | A | 1/1941 | Benander |
| 2,277,348 | A | 3/1942 | Parish |
| 2,291,808 | A | 8/1942 | Henning |
| 2,297,374 | A | 9/1942 | Tingle |
| 2,300,870 | A | 11/1942 | Carlson |
| 2,314,033 | A | 3/1943 | Curran |
| 2,325,817 | A | 8/1943 | Watrous, Jr. |
| 2,336,529 | A | 12/1943 | Cartun |
| 2,336,556 | A | 12/1943 | Malloy |
| 2,385,478 | A | 9/1945 | Steinmayer |
| 2,403,137 | A | 7/1946 | Strickland |
| 2,456,376 | A | 12/1948 | Chirelstein |
| 2,466,566 | A | 4/1949 | Tiscione |
| 2,519,328 | A | 8/1950 | Whitemore et al. |
| 2,522,907 | A | 9/1950 | Streb |
| 2,523,357 | A | 9/1950 | Chirelstein |
| 2,610,431 | A | 9/1952 | Osborn et al. |
| 2,620,374 | A | 12/1952 | Benander |
| 2,647,246 | A | 7/1953 | Gilbert |
| 2,655,637 | A | 10/1953 | Godfrey et al. |
| 2,687,028 | A | 8/1954 | Stein |
| 2,688,669 | A | 9/1954 | Quill |
| 2,695,393 | A | 11/1954 | Tiscione |
| 2,700,143 | A | 1/1955 | Landgraf |
| 2,701,868 | A | 2/1955 | Pate et al. |
| 2,716,737 | A | 8/1955 | Maberry |
| 2,721,985 | A | 10/1955 | Gilbert |
| 2,732,532 | A | 1/1956 | Tamis |
| 2,736,873 | A | 2/1956 | Bechard et al. |
| 2,747,168 | A | 5/1956 | Arena |
| 2,774,050 | A | 12/1956 | Logan |
| 2,800,635 | A | 7/1957 | Christenbery |
| 2,821,649 | A | 1/1958 | Geiger |
| 2,912,665 | A | 11/1959 | Irwin |
| 2,913,697 | A | 11/1959 | Caplis et al. |
| 2,919,422 | A | 12/1959 | Thomas et al. |
| 2,958,006 | A | 10/1960 | Kirka |
| 2,965,875 | A | 12/1960 | Danesi |
| 2,968,783 | A | 1/1961 | Puetz |
| 2,972,125 | A | 2/1961 | Temple et al. |
| 2,975,556 | A | 3/1961 | Baird |
| 2,984,810 | A | 5/1961 | Kawate |
| 2,987,696 | A | 6/1961 | Rudler et al. |
| 2,988,725 | A | 6/1961 | Vallee |
| 2,993,192 | A | 7/1961 | Mouat |
| 2,999,220 | A | 9/1961 | Werner |
| 3,019,407 | A | 1/1962 | Donsky |
| 3,028,523 | A | 4/1962 | Seid |
| 3,028,525 | A | 4/1962 | Morton |
| 3,047,765 | A | 7/1962 | Vichill |
| 3,054,079 | A | 9/1962 | Kawate |
| 3,060,344 | A | 10/1962 | Scholes |
| 3,067,399 | A | 12/1962 | Matsui |
| 3,080,497 | A | 3/1963 | Noel et al. |
| 3,084,304 | A | 4/1963 | Sloan |
| 3,118,617 | A | 1/1964 | Hellrich |
| 3,131,986 | A | 5/1964 | Edwards |
| 3,148,305 | A | 9/1964 | Pearson |
| 3,162,502 | A | 12/1964 | Verbeek |
| 3,165,371 | A | 1/1965 | Ruocco |
| 3,170,750 | A | 2/1965 | Appleton |
| 3,211,938 | A | 10/1965 | Holcomb |
| 3,217,116 | A | 11/1965 | Martin et al. |
| 3,245,025 | A | 4/1966 | Goddard et al. |
| 3,253,179 | A | 5/1966 | Edwards et al. |
| 3,259,868 | A | 7/1966 | Irwin |
| 3,265,922 | A | 8/1966 | Verbeek |
| 3,286,215 | A | 11/1966 | Hagner |
| 3,296,400 | A | 1/1967 | Kienzle |
| 3,300,711 | A | 1/1967 | Duncan |
| 3,302,019 | A | 1/1967 | Menzin |
| 3,309,646 | A | 3/1967 | Goodman |
| 3,315,216 | A | 4/1967 | Krupp et al. |
| 3,368,184 | A | 2/1968 | Braun |
| 3,372,362 | A | 3/1968 | Schick |
| 3,414,762 | A | 12/1968 | Wyzykowski |
| 3,422,393 | A | 1/1969 | Plagge |
| 3,452,214 | A | 6/1969 | Martin |
| 3,489,991 | A | 1/1970 | Hillzen |
| 3,496,451 | A | 2/1970 | Duncan |
| 3,504,329 | A | 3/1970 | Peterson et al. |
| 3,510,641 | A | 5/1970 | Reynolds |
| 3,514,742 | A | 5/1970 | Reinherz |
| 3,530,422 | A | 9/1970 | Goodman |
| 3,534,217 | A | 10/1970 | Vause et al. |
| 3,551,725 | A | 12/1970 | Brundige |
| 3,573,534 | A | 4/1971 | Leighton |
| 3,597,725 | A | 8/1971 | Beck et al. |
| 3,609,645 | A | 9/1971 | Turner |
| 3,611,009 | A | 10/1971 | McNeil |
| 3,622,947 | A | 11/1971 | Griffin |
| 3,629,640 | A | 12/1971 | Audesse et al. |

3,638,068 A 1/1972 Wilson
3,644,867 A 2/1972 Krause
3,666,988 A 5/1972 Bellis
3,671,917 A 6/1972 Ammon et al.
3,673,534 A 6/1972 Marinace
3,706,902 A 12/1972 Cookson
3,715,623 A 2/1973 Szabo
3,716,818 A 2/1973 Finkelstein
3,729,700 A 4/1973 Johnson et al.
3,735,116 A 5/1973 Morrison
3,746,906 A 7/1973 Cardwell, Jr.
3,755,773 A 8/1973 Johnson
3,757,105 A 9/1973 McCarthy
3,757,277 A 9/1973 Yamanoue et al.
3,775,634 A 11/1973 Hasell et al.
3,783,435 A 1/1974 Fisher
3,784,867 A 1/1974 Dupree
3,816,653 A 6/1974 Bosiger
3,839,689 A 10/1974 Biltcliffe et al.
3,890,027 A 6/1975 Orr et al.
3,897,124 A 7/1975 Pagnotta et al.
3,955,876 A 5/1976 Knuppel
3,976,349 A 8/1976 Kenyon et al.
3,993,386 A 11/1976 Rowe
4,020,382 A 4/1977 Bolt et al.
4,044,277 A 8/1977 Komyati
4,101,805 A 7/1978 Stone
4,152,629 A 5/1979 Raupp
4,156,265 A 5/1979 Rose
4,159,157 A 6/1979 Koehler
4,163,923 A 8/1979 Herbers et al.
4,184,734 A 1/1980 Toorell
4,198,112 A 4/1980 Miller
4,211,959 A 7/1980 Deavenport et al.
4,246,632 A 1/1981 Hancox
4,254,363 A 3/1981 Walsh
4,257,664 A 3/1981 Munroe
4,262,980 A 4/1981 Heritage
4,289,972 A 9/1981 Wern
4,350,930 A 9/1982 Peil et al.
4,382,654 A 5/1983 Schick
4,392,076 A 7/1983 Ishler et al.
4,392,081 A 7/1983 Brown et al.
4,429,942 A 2/1984 Johnson et al.
4,441,782 A 4/1984 Kneer
4,447,760 A 5/1984 Koo
4,450,510 A 5/1984 Nilssen
4,456,322 A 6/1984 Ferroni
4,456,857 A 6/1984 Orr et al.
4,495,446 A 1/1985 Brown et al.
4,496,874 A 1/1985 Sanders et al.
4,499,398 A 2/1985 Munroe
4,502,103 A 2/1985 Collins
4,556,822 A 12/1985 Lohrey et al.
4,586,967 A 5/1986 Shapiro et al.
4,595,969 A 6/1986 McNair
4,605,877 A 8/1986 Cho et al.
4,610,498 A 9/1986 Thomas
4,613,790 A 9/1986 Roorda
4,660,919 A 4/1987 Levy
4,752,245 A 6/1988 Knecht
4,764,708 A 8/1988 Roudeski
4,768,966 A 9/1988 Doherty
4,777,573 A 10/1988 Liao
4,778,409 A 10/1988 Maddock
4,787,865 A 11/1988 Livera et al.
4,807,098 A 2/1989 Ahroni
4,807,099 A 2/1989 Zelin
4,816,698 A 3/1989 Hook
4,816,977 A 3/1989 Sorensen
4,911,656 A 3/1990 Yu
4,915,667 A 4/1990 Tobias-Pader
4,928,032 A 5/1990 Skoch et al.
4,934,963 A 6/1990 Gardner et al.
4,990,820 A 2/1991 Suster et al.
4,999,752 A 3/1991 Rogers et al.
5,006,751 A 4/1991 Marshall
5,015,924 A 5/1991 Berman et al.
5,024,406 A 6/1991 Ketcham
5,051,877 A 9/1991 Liao
5,066,896 A 11/1991 Bertenshaw et al.
5,108,311 A 4/1992 Nakazawa
5,113,044 A 5/1992 Tomberlin
5,134,554 A 7/1992 Donato et al.
5,137,454 A 8/1992 Baechtle
5,192,218 A 3/1993 Kuiper
5,208,516 A 5/1993 Saidian
5,218,216 A 6/1993 Manabe et al.
5,228,774 A 7/1993 Liao
5,249,112 A 9/1993 Bray
5,252,888 A 10/1993 Topel et al.
5,263,881 A 11/1993 Henrici et al.
5,304,076 A 4/1994 Pelton et al.
5,306,173 A 4/1994 Suzuki
5,306,179 A 4/1994 Korenowski
5,328,385 A 7/1994 Cheu
5,380,214 A 1/1995 Ortega, Jr.
5,380,215 A 1/1995 Huang
5,382,181 A 1/1995 Ortiz
5,389,008 A 2/1995 Cheng et al.
5,401,191 A 3/1995 Krage, Jr. et al.
5,421,742 A 6/1995 Huang
5,453,655 A 9/1995 Helbig et al.
5,562,481 A 10/1996 Myson
5,573,419 A 11/1996 Chen
5,586,904 A 12/1996 Huang
5,595,493 A 1/1997 Chen
5,622,513 A 4/1997 Kuang
5,634,812 A 6/1997 Chen
5,641,303 A 6/1997 Chiu
5,660,561 A 8/1997 Tseng
5,683,271 A 11/1997 Newman
5,698,935 A 12/1997 Newman
5,779,497 A 7/1998 Hale et al.
5,795,179 A 8/1998 Lin
5,807,134 A 9/1998 Hara
5,853,299 A 12/1998 Wu
5,860,830 A 1/1999 Wu
5,967,847 A 10/1999 Newman
5,990,606 A 11/1999 Ross
6,015,313 A 1/2000 Davis et al.
6,033,248 A 3/2000 Lyons
6,224,410 B1 5/2001 Chen
6,234,649 B1 5/2001 Katougi
6,322,380 B1 11/2001 Conroy
6,328,593 B1 12/2001 Chang et al.
6,469,427 B1 10/2002 Itaya et al.
6,491,534 B1 12/2002 Bonard et al.
6,616,298 B1 9/2003 Bernhard
6,672,890 B1 1/2004 Witherspoon
6,690,102 B2 2/2004 Maassen et al.
6,779,911 B2 8/2004 Chang

| Bulb wattage | Bulb contact (205) | Socket contact ring (305) | Aperture of ring (307) |
|---|---|---|---|
| up to 60 | Approx. 13mm | Approx. 11-15mm | Approx. 11mm |
| over 60 up to 100 | Approx. 8mm | Approx. 6-11mm | Approx. 6mm |
| over 100 | Approx. 3mm | flat spring contact | |

Fig. 8

LIGHTING SYSTEM HAVING MODIFIED LIGHT BULB BASE AND LUMINARE SOCKET FOR PREVENTING THE SELECTION OF AN OVER WATTAGE LIGHT BULB AND METHOD OF FORMING SAME

FIELD OF THE INVENTION

The present invention relates generally to electric incandescent light bulb bases and more particularly to a modified incandescent light base and luminare socket for selecting appropriate bulb wattage.

BACKGROUND

Today's common household incandescent light bulb bases and receiving sockets remain compatible with Thomas Edison's design. Such compatibility is useful, but it prolongs a safety issue that has increased substantially since Mr. Edison's day. As seen in prior art FIG. 1A, the typical Edison bulb 100 includes the bulb 101 and lower section having a threaded base 103 which fastens within an accompanying luminare socket. Prior art FIG. 2 illustrates the bottom view of the Edison or threaded base wherein a contact 105 located at the center of the concentric conductor 107 is used to supply electrical current to filaments (not shown) within the glass envelope. The contact 105 and concentric conductor 107 are insulated from the threaded base 103 using an insulative material 109. The threaded base 103 screws into an accompanying luminare socket (not shown) that is connected to a lamp or other electrical device. The luminare socket typically uses a flat spring bar which makes electrical contact with a corresponding contact 105 on the bottom of the threaded base 103. Luminare socket manufacturers typically apply warning labels or other indicia on the luminare socket with recommendations for the maximum wattage bulb that is to be used with the base. When these recommendations are followed, this limits both the heat generated by the bulb and electrical current used by the device.

Those skilled in the art will recognize that there is no way to assure that these recommendations to consumers will be followed. For example, a 200-watt incandescent bulb is the same size as a 40-watt bulb, but it generates much more heat when illuminated. Excessive heat can deteriorate the insulation both on the electrical wires connecting to the luminare socket and on the supply wires in the junction box above the luminare. This deterioration, typically in the form of brittleness and cracking, can lead to arcing, and a subsequent fire.

Previous inventors have made adjustments to Edison's light bulb base design. U.S. Pat. No. 656,284, which is incorporated by reference herein, teaches the use of bulb tips having various sizes to prevent other bulbs or fuses from being interchanged. U.S. Pat. No. 4,456,322, which is also incorporated by reference herein, discloses lamp wattage limiting devices that use a contact having a predefined geometric configuration to define the bulb wattage that may be used on the luminare socket. U.S. Pat. Nos. 2,519,328; 2,701,868; 2,999,220; 3,131,986; 3,309,646; and 5,401,191, which are all incorporated by reference herein, show various contact and socket base configurations that allow use with multiple filament bulbs.

Consequently, the need exists for a bulb and luminare socket where the maximum wattage of the bulb is controlled by the socket of the luminare. Moreover, any newly designed light bulb bases must be compatible with existing Edison sockets, and existing light bulbs must work in at least some of the newly designed sockets.

BRIEF DESCRIPTION OF THE FIGURES

The accompanying figures, wherein like reference numerals refer to identical or functionally similar elements throughout the separate views, and which together with the detailed description below are incorporated in and form part of the specification, serve to further illustrate various embodiments and to explain various principles and advantages all in accordance with the present invention.

FIG. 8 is a chart illustrating the approximate size of the contacts on the modified Edison base and luminare socket in accordance with the invention.

Figure 1:
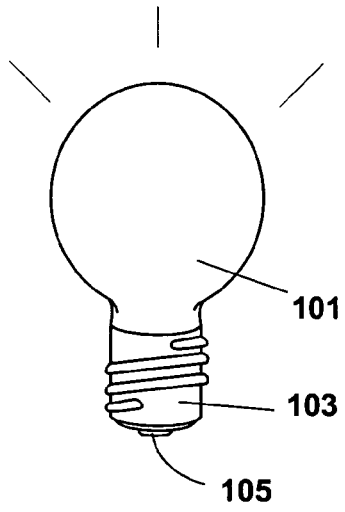
Fig. 1 (PRIOR ART)
FIG. 1 is a prior art diagram illustrating a side perspective view of a standard light bulb with Edison base.
Figure 2:
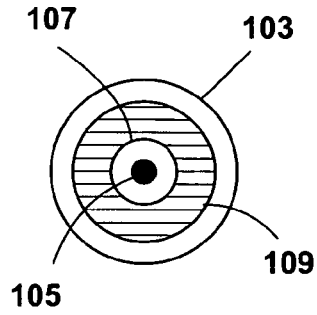
Fig. 2 (PRIOR ART)
FIG. 2 is a prior art diagram illustrating a bottom view Edison bulb base as seen in FIG. 1.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to a modified Edison light base and luminare socket. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

Figure 3:
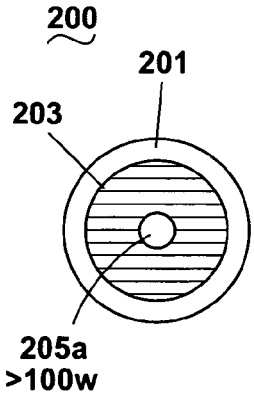
FIGS. 3, 4 and 5 are bottom perspective views of the modified Edison base in accordance with an embodiment of the invention.
Figure 4:
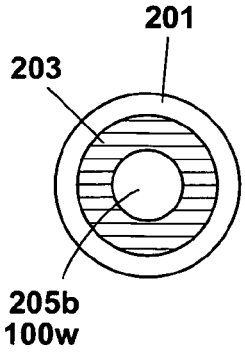
Figure 5:
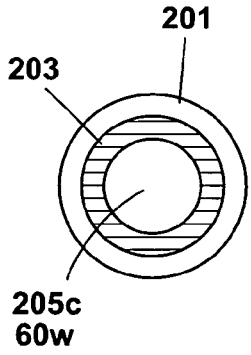

As illustrated in FIGS. 3–5, the invention involves modifying both the light bulb base as well as the luminare socket used with the base. Although a standard Edison bulb base is described herein, those skilled in the art will recognize that any oversized light bulb and luminare socket would benefit from the advantages of the invention, as would multifilament, or three-way, luminare sockets. These oversized light bulb bases and luminare sockets are also known as moguls.

FIG. 3 illustrates a modified light bulb base where the contact at the bottom of the bulb base is specifically sized to be small, typically 3 millimeters (mm) in diameter. FIG. 4 illustrates a modified light bulb base where the contact at the bottom of the bulb base is 8 mm in diameter. FIG. 5 illustrates a modified light bulb base where the contact at the bottom of the bulb base is 13 mm in diameter. Each bulb base 200 includes the standard sized threaded base 201, an insulative material 203 and a center contact 205*a*, 205*b*, or 205*c* specifically sized so as to operate with a specific type of luminare socket. As seen in FIGS. 3–5, the size of the contact 205*a*, 205*b*, or 205*c* will vary with the wattage of the bulb. Thus, a light bulb greater than 100 watts will feature a small contact 205*c* which has a diameter typically 3 mm in size. A bulb between 61 watts and 100 watts will use a slightly larger contact 205*b* with a diameter that is approximately 8 mm in size while a bulb 60 watts or less will use the largest contact 205*a* that is approximately 13 mm in diameter.

Figure 6:
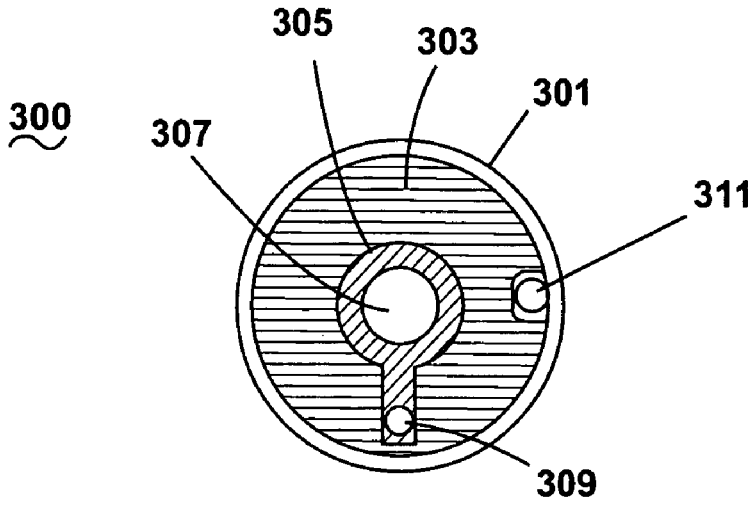
FIG. 6 is a top perspective view of a modified luminare socket in accordance with an embodiment the invention.
Figure 7:
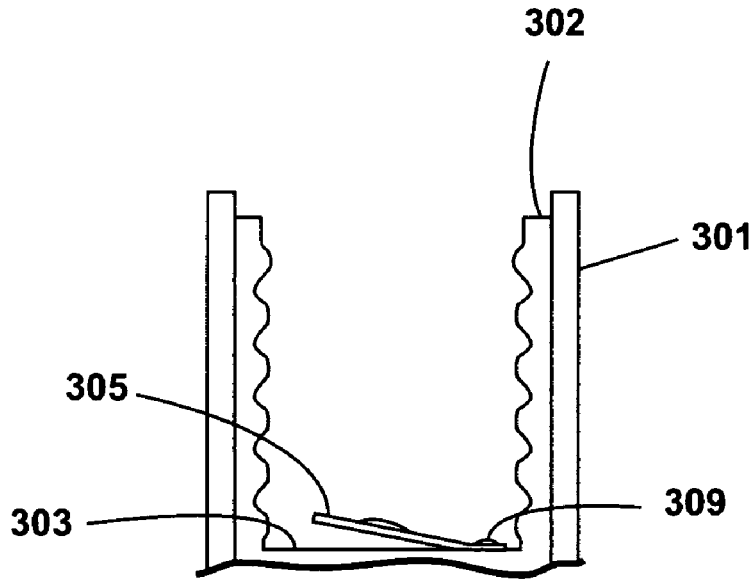
FIG. 7 is a side cross-sectional view of the modified luminare socket as shown in FIG. 6.

FIGS. 6 and 7 illustrate top and cross-sectional views, respectively, of an accompanying luminare socket 300 in accordance with the invention. As with the standard luminare socket, the modified luminare socket 300 includes a circular outer shell 301. The outer shell 301 is electrically conductive and includes threaded sides 302 on the inner side of the shell for receiving the threaded base of the modified Edison bulb. An insulating material 303 such as rubber, plastic or the like is used to insulate the contact ring 305*a* or 305*b* from the outer shell 301. The contact ring 305*a* or 305*b* is a metallic conductive material that is substantially circular having an internal hole or aperture 307*a* or 307*b*. The contact ring 305*a* or 305*b* further includes a flat extension 309 at one end for attaching a wire conductor using a rivet or other fastener. Together, the contact ring 305 and the flat extension 309 form a resilient spring similar to the one in current usage. The flat extension 309 is typically connected with the "hot" wire of a 120-volt alternative current (AC) power source. Another rivet 311 is used at the outer shell 301 for also connecting a wire conductor typically used for carrying the grounded (neutral) current to the outer shell.

In operation, it should be evident to those skilled in the art that the modified Edison base and contacts 205*a*, 205*b* or 205*c* work in combination with the luminare socket and contact rings 305*a* or 305*b*, respectively, to control the bulb wattage that may be used with that specific luminare socket For example, a light bulb over 60 watts with a small center contact 205*b* or 205*c* will not make an electrical connection with contact ring 305*a*, with its 11 mm aperture 307*a*. Instead, the center contact may make harmless contact with the insulating material 303 or make no contact at all. Thus the bulb, while fitting in the screw shell socket, will not illuminate. FIG. 8 is a chart that illustrates the approximate sizing relationship between the light bulb wattages and contacts 205*a*, 205*b* and 205*c*, contact rings 305*a* and 305*b*, apertures 307*a* and 307*b*, and the flat spring contact (not shown).

Since luminare sockets designed for over 100 watt incandescent bulbs must permit all bulbs 100 watts or less to also illuminate, the present flat spring type of contact in the socket is the preferred design for these sockets. The flat spring contact allows proper electrical contact with each of the modified bulb bases having contacts 205*a*, 205*b* and 205*c*. Luminare sockets designed for light bulbs over 60 watts and up to 100 watts must permit 60-watt or lower light bulbs to also illuminate, thus their aperture size 307*b* is 6 mm. Therefore, light bulbs with contacts 205*a* and 205*b* will make electrical contact and illuminate when screwed in, while light bulbs with contact 205*c* will not make a connection. Luminare sockets designed only for light bulbs 60 watts or lower feature an aperture size 307*a* of 11 mm, permitting only light bulbs with contacts 205*a* to illuminate.

Multifilament or three-way, light bulbs benefit from this invention without revising the light bulb design. The bottoms of their bases feature a center "hot" contact and another one off center. The receiving socket for three-way light bulbs would be modified to include a center contact, preferably spring-mounted for positive contact, as shown in U.S. Pat. Nos. 803,246; 1,774,517; 2,890,435; and 3,890,027, and a large resilient ring with a wide aperture for the second "hot" contact. Insulating material 303 will separate the center spring contact from the resilient ring 305*a* when the bulb is screwed into the modified luminare socket 300.

Given that the invention specifies at least three electrical device base designs and corresponding socket designs, color-coding the insulating material 203 and 303 is suggested but not required. For example, yellow, orange and red insulation would identify lower, medium and higher wattage bases and sockets, respectively. Such color-coding would facilitate the use of properly sized light bulbs or devices in the luminares or apparatus.

Thus, the invention describes a modified electrical contact system for the Edison screw-in base and receiving socket, with three ranges of electrical current. It permits current to flow to the lowest range device when the device is screwed into any of the three sockets. It permits current to flow only to the medium range device when the device is screwed into the medium or high range socket. It permits current to flow only to the high range device when the device is screwed into a high range socket. The design modification to the screw-in base is that the center contact at the bottom of the base is to be a specific diameter, with a certain amount of variation acceptable, to correspond to an associated socket. The design modifications to the corresponding sockets are the contact rings having apertures in various sizes that prevent higher wattage devices using smaller contacting bases from making any electrical contact with the ungrounded or "hot" side of the socket.

In the description and drawings referenced above, the common light bulb has been used to explain the invention's modifications to the Edison screw base design. However, it is not the inventor's intention to limit the benefits of the invention to light bulbs, but instead to extend them to all uses of the screw base design.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as critical, required, or essential features or elements of any or all the claims. The invention is defined solely by the appended claims including any amendments made during the pendency of this application and all equivalents of those claims as issued.

I claim:

1. A lighting system including a light bulb base and luminare socket for preventing use of an over wattage light bulb comprising:

a threaded bulb base having a base contact for providing electrical contact to at least one filament, a luminare socket having a ring contact for providing electrical contact with the base contact; and wherein the ring contact includes an aperture such that the ring contact can only make electrical contact with the base contact when the diameter of the base contact is of a predetermined size.

2. A lighting system as in claim 1, wherein the diameter of the base contact is selected based upon the wattage of the light bulb.

3. A lighting system as in claim 1, wherein a substantially large diameter base contact is used with lower wattage bulbs.

4. A lighting system as in claim 1, wherein a substantially small diameter base contact is used with higher wattage bulbs.

5. A lighting system as in claim 1, wherein the aperture is sized so to make electrical contact with a base contact on a bulb having a predetermined wattage.

* * * * *